US008477081B2

(12) United States Patent
Daniel

(10) Patent No.: US 8,477,081 B2
(45) Date of Patent: Jul. 2, 2013

(54) LOUVER DEVICE

(75) Inventor: Jurgen H. Daniel, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1168 days.

(21) Appl. No.: 12/357,170

(22) Filed: Jan. 21, 2009

(65) Prior Publication Data

US 2010/0182218 A1 Jul. 22, 2010

(51) Int. Cl.
*G09G 5/00* (2006.01)

(52) U.S. Cl.
USPC ..... 345/1.3; 345/55; 345/82

(58) Field of Classification Search
USPC ..... 345/1.3, 55, 82
See application file for complete search history.

(56) References Cited

U.S. PATENT DOCUMENTS

| | | | | |
|---|---|---|---|---|
| 5,271,447 | A * | 12/1993 | Aronovich | 160/236 |
| 5,655,589 | A * | 8/1997 | Vartanian | 160/166.1 |
| 5,906,083 | A * | 5/1999 | Olsen et al. | 52/473 |
| 7,617,857 | B2 * | 11/2009 | Froese | 160/10 |
| 2002/0161856 | A1 * | 10/2002 | Pineau et al. | 709/219 |
| 2003/0067432 | A1 * | 4/2003 | Watanabe et al. | 345/87 |
| 2007/0215200 | A1 * | 9/2007 | Lim | 136/246 |
| 2009/0251393 | A1 * | 10/2009 | Fan | 345/82 |

* cited by examiner

*Primary Examiner* — William L Boddie
*Assistant Examiner* — Leonid Shapiro
(74) *Attorney, Agent, or Firm* — Marger Johnson & McCollom PC

(57) ABSTRACT

A display has a louver shade having at least two louver segments, a display segment mounted on each louver segment, each display segment being a part of a larger display, drive electronics electrically coupled to each display segment to provide image data to display elements in the display segment, and a control circuit to provide the image data to the drive electronics, the control circuit arranged to provide display data when the louver segments are in a closed position.

12 Claims, 7 Drawing Sheets

LOUVER DEVICE

BACKGROUND

As advances occur in display technologies, including the ability to manufacture the necessary addressing electronics inexpensively and with higher yields, non-traditional form factors for displays become possible. Curved, hemispherical and spherical displays may soon exist, as well as 'shaped' displays that could be shaped to a particular surface as desired.

Similarly, the movement away from scanning display technologies, such as the traditional cathode ray tubes (CRTs) has resulted in most displays consisting of an X-Y grid of pixels, or picture elements. This provides an opportunity to segment or divide up the pixels into groups and allow those groups to be addressed as if they still resided in a complete X-Y grid.

With the increased manufacturing capabilities, displays have begun to replace traditional painted or printed signs in venues ranging from coffee shops and bookstores to grocery stores and airports. Displays may be used as 'changeable art' where still pictures are displayed and changed at the user's desire. Surfaces that previously had been painted are now the platform for programmable displays.

One such surface is louver window shades. A louver window shade typically consists of a set of slats or bars that are mounted by their sides to a window frame. When the shades are rotated so their flat surfaces are pointing up and down, they allow air and/or light into a room. When the user rotates the slats such that the flat surfaces are pointing towards the room and away from the room, the slats block the light and/or the air.

Being able to use the slats of a louver window shade as a programmable display would afford many new opportunities and functionalities for displays.

DETAILED DESCRIPTION OF THE EMBODIMENTS

Figure 1:
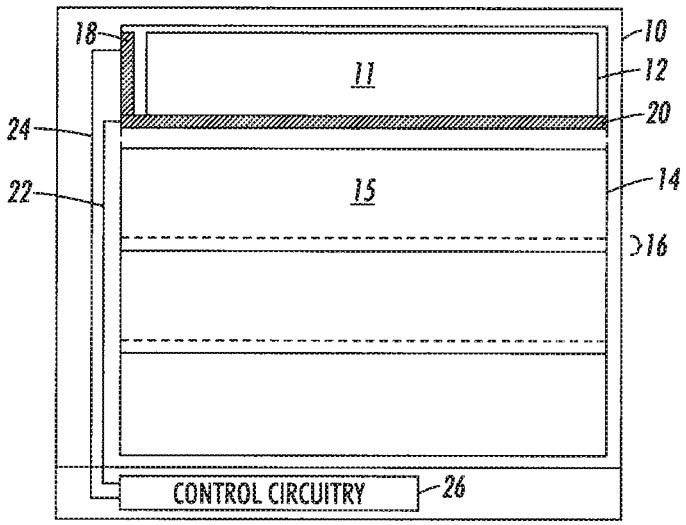
FIG. 1 shows a front view of a block diagram of an embodiment of a louver display having control lines.
Figure 2:
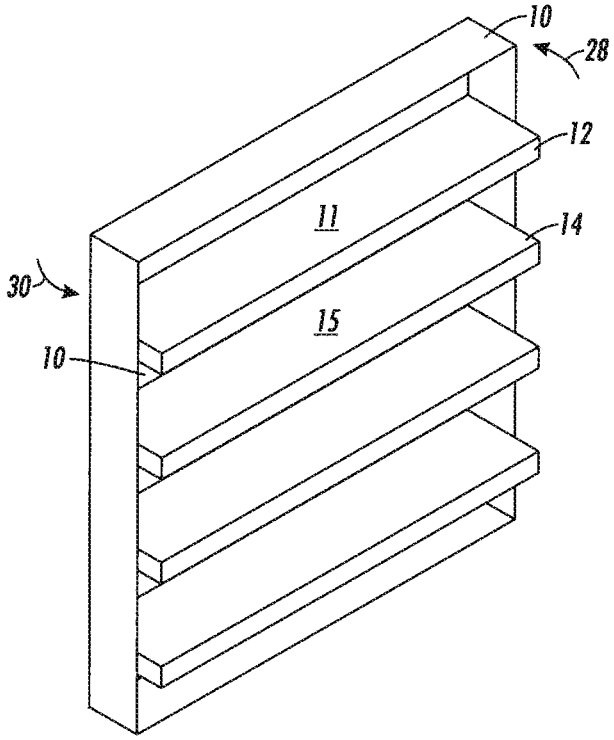
FIG. 2 shows a side view of a louver display in the open state.

FIGS. 1 and 2 show an embodiment of a louver-type window shade usable as a display. A louver window shade 10 generally consists of louver segments such as 12 and 14 mounted such that they are rotatable between a closed position and an open position. FIG. 1 shows a louver shade usable as a display in the closed position.

Each louver segment generally consists of a slat or long piece of material having two flat surfaces that are generally appropriate for use as a display. In FIG. 1, louver segment 14 has a front surface 15. Surface 15 has an opposite surface that cannot be seen in this drawing. Generally, surface 15 will have a vertical extent that is much shorter than its horizontal extent.

When in the closed position, a portion of the adjacent louver segments may overlap in some small region and cover part of the louver segment. In the embodiment shown in FIG. 1, for example, the bottom of louver segment 14 is partially covered by the next lower louver segment in the region 16.

For purposes of the discussion here, louver segment 12 has been extracted from the louver display to show otherwise hidden portions. It must be noted that depending upon the direction in which the louver segments are rotated, the overlap may occur at the top region, or possible not at all.

Louver segment 12 has a front surface usable as a display, but because of the overlap regions as well as a possible need to provide local driving lines, the usable portion of the front surface may only comprise a portion 11 of the louver segment 12. In the embodiment shown in FIG. 1, the display may be addressed by an active-matrix pixel backplane. In this case, the driver circuitry for the data and gate lines of the display segment 11 of the louver segment may reside in the peripheral edges of the louver segment 12, as shown by regions 18 and 20. The display segment 11 will generally consist of an array of display elements, wherein each display element corresponds to a picture element (pixel) in a displayed image. The elements may be one of several different display technologies, as will be described further.

The driver circuitry may be integrated on the substrate that contains the pixel circuit such as in a system on glass approach, or the circuits may be attached as discrete driver chips such as by TAB (tape automated bonding) bonding technique. Direct integration of pixel circuits and driver circuits may occur by technologies based on amorphous silicon, polysilicon or metal oxides such as ZnO, InGaZnO, etc., for example. The conducting lines may consist of metals such as aluminum, copper, silver, chrome, but they also may consist of substantially transparent conducting materials such as ZnO, Indium Tin Oxide, Carbon nanotubes and organic conductors such as PEDOT. In the case of a pixel backplane that has been fabricated by a printing method, the driver circuits may be printed onto the substrate together with the pixels.

The display may be also addressed by a passive-matrix driving method. In this case, the horizontal and vertical lines may be on opposite substrates with the display medium sandwiched in-between as in a liquid crystal medium. The lines may be on the same substrate, separated by a dielectric layer as in some passive-matrix light emitting diode displays. In either case the driver circuits are attached to the horizontal and vertical bus lines. Although the following discussion talks about gate and data lines, the case of a passive matrix display applies to all the discussions as well. Therefore, the gate lines shall be equivalent to the vertical lines and the data lines equivalent to the horizontal lines in a passive-matrix addressed display.

The panel 11 may consist of a directly addressed display. In this case, at least two electrodes are routed to each display element. The electrodes may be on the same substrate or they may be on different substrates. One of the electrodes may be common to all of or to an array of the display elements.

Other configurations of driver lines may also be possible. For example, the gate lines may traverse the length of the louver shade, with breaks between the louver segments, such that when they are rotated to the closed position, the lines overlap and come into mechanical contact. This mechanical contact could complete the circuit and allow the control circuitry to have complete gate lines running the length of the display. The electrical contact between the segments may be improved by a magnetic force, such as by placing small magnets near the edges of the segments or by attaching a strip of magnetic material to the edges such as magnetic tape. Elastic anisotropic tape such as a zebra contact strip which is common in LCD contacts may be used to establish contact between the segments. If the segments are self-contained, where they do not 'share' a common image, the contacts may transmit video signals and supply power.

Alternatively, the gate lines residing in region 20 that address the display elements from the top or bottom of the display may traverse the horizontal edge of each louver segment to connect to the gate lines such as 22 from the control circuitry 26. Alternatively the gate lines may traverse the horizontal edge of each louver segment and connect to a gate line driver circuit attached to the lateral edge of the segment near region 18. The gate line driver circuit would then connect to the control circuitry with fewer wires. Typical electronic elements of the gate or data line driver circuits are shift registers, level shifters and latching circuits. The data lines from region 18 may connect along the side of the louver shade such as line 24. The data lines may directly connect to the control circuit or they may be connected to a data line driver circuit which then connects to the control circuitry. The data line driver circuit also typically contains shift registers, level shifters and latching circuit and it may be directly integrated onto the backplane or separately attached to the backplane (e.g. via TAB bonding or via ball grid array bonding, etc.). This allows the display segment to be addressable, while ensuring that the lines do not block the view when the shades are in the open position.

In the described display, the data signals and voltage supply may be connected from each segment directly to a control circuit or they may be passed on from one segment to a neighboring segment (daisy-chain like) and the main control circuit would be connected to the last segment in the chain. In FIG. 1, the connections from the louver segments to the control circuit are only shown on one side. However, the regions 18 and connections 22 and 24 may also be arranged on both sides of the display segments. This may be advantageous in larger displays in order to transfer the display data more rapidly. The control circuitry 26 may contain a video signal processor, power supply and other electronics required to drive a display panel. It also may contain a wired or wireless connection to transfer image data, e.g. via the internet. Moreover, the connection 22 and 24 may not be wire connections, but wireless communication connections. Each panel 11 may have a radio frequency circuit included that can communicate to the control circuit 26 or that can communicate wirelessly between the segments. An antenna circuit may be printed onto or attached to the segments and Bluetooth communication is just one example for exchanging wireless data. In the case of completely wireless segments, a power source such as a battery, such as thin film battery or button cell, or a solar cell have to be included in each segment.

In addition to the driving signals, the control circuitry 26 may monitor a detector or some electrical property in the lines that indicates when the louver segments are open or closed. Depending upon the data being displayed, the control circuitry may buffer incoming video signals and not send them to the display segments when the louver segments are open. For example, if a viewer were watching a movie and wanted to stop for a moment to look outside the viewing environment, the control circuitry would either stop the movie, or buffer the data of the next images to be displayed until the louvers close again.

When the louvers are opened, as shown in FIG. 2, they may be closed again by rotating back in the opposite direction. For example, if the louver segments in FIG. 1 were rotated in the direction of the arrow 28 to open and then in the opposite direction to close, the display data could then be sent to the display segments as before. The surface 15 would appear as the 'top' of the louver segment 14 and would return to the position as shown in FIG. 1.

However, if the louver segments were rotated as shown in FIG. 2, and then rotated along the same direction, as shown by arrow 30, the surface 15 would be pointed away from the viewer 180 degrees away from their previous closed position. In this case, the display data may need to be flipped to account for the reorientation of the top and bottom of the display segments, as well as display on a different side.

In this case, if the viewer had been looking at side A with segments having a top and bottom, when they are flipped, the viewer is seeing side B. The top of side A is now the bottom of side B. The image data must be re-routed to accommodate this.

In addition to a display segment on the side of the louver segments shown in FIG. 1, there may be a display segment on the other side of the louver as well. The display technologies may consist of the same display technology, or may be a different technology. For example, one side may use a display technology that is better viewed in darker environments if that side faces an indoors viewing environment. In at least one embodiment, the individual louver segments are coordinated, meaning that the display signals of the elements are coordinated to form together a larger variable information image such as a picture or a text message.

The other side may employ a display technology that is better viewed in light environments, such as an outdoor environment, or is more robust to weather conditions. Examples of display technologies include light emitting diode (LED) displays having one or more rows of LEDs in each display segment; plasma displays, LCD displays including nematic LCDs, ferroelectric LCDs, reflective cholesteric LCDs, polymer dispersed LCDs, or backlit/transflective LCDs; OLED displays; other reflective types of displays such as electrophoretic, powder, Gyricon displays, electrochromic, electrodeposition, interference or electrowetting displays; and electroluminescent displays. In general, the display technology may be emissive or reflective in nature and in some cases it may be a bistable technology for power saving purposes, for example.

It should also be noted that in a display, only a part of the louver segments may be rotated. For example, the upper half may be rotated to 90 degrees and therefore be quasi-transparent, while the lower half may be closed and display changing image information. Also, if one side of the louver segments consists of a bistable reflective display and the other side consists of a LCD display, for example, the segments may be rotated to show in the upper portion a static message (with infrequent updates) while displaying a movie in the lower section. Or, if one side of the louver segments contains a light source, such as an LED strip, and the other side a reflective display, such as electrophoretic display, the upper segments may be rotated to provide illumination of the reflective display in the lower section, for example. Also if one side of the louver segments has a mirror surface, light may be redirected to illuminate a reflective display. For example, if the louver display is mounted as a window, external light may be redirected by the mirror surface of a partially rotated, such as a 45 degree rotation, louver segment onto the front side of the louver screen.

Figure 3:
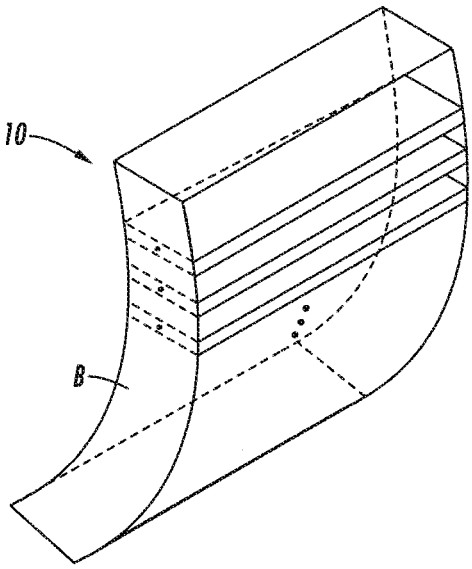
FIGS. 3 and 4 show alternative configurations for a louver display.
Figure 4:
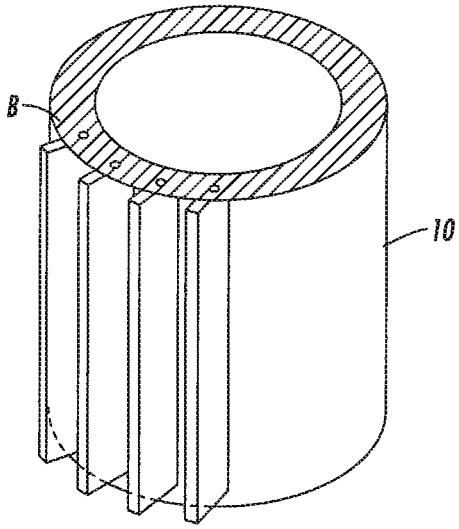

The louver display panel might also be configured as a curved or cylindrical display. For example, FIG. 3 shows that the vertical sections of the frame 13 may be curved, as just an example, with many other curves including 'S' shapes are possible. The frame may also be cylindrical, as shown in FIG. 4. The display 10 could be organized around a shape, such as a circle, an ellipse or a hemispherical shape, like a capital 'D.' This may have architectural advantages, for example when the display is integrated into a building. The louver segments may also be oriented vertically in a window frame, similar to the orientation of FIG. 4, but in a more traditional window setting.

Many other options exist for the non-display side of the louver in a one-sided display. In one embodiment, the non-display side of the louver could be a solar panel that could at least assist in powering the display. Generally, the solar cell would only receive light when the louver were closed, but power storage may be included in the control circuitry to take advantage of any power generated in either the closed or open positions. The solar panel may consist of thin-film solar cells such as amorphous silicon based solar cells, organic solar cells, dye-sensitized solar cells, CIGS or CdTe based solar cells, etc. The solar panels may also consist of crystalline or polycrystalline solar cells or thin concentrator-type solar cells.

The non-display side of the louver could also be a reflective mirror surface, a simple areal light source to provide illumination such as an electroluminescent surface, a large area OLED lighting panel, an array of light emitting diodes (e.g. mounted as LED strips on each louver segment). The non-display side may also be a fixed image such as a printed image where each louver segment has a part of the image printed on it. In one example, the non-display side of the louver is a light guide, consisting of a light guide with a light scattering and diffusing surface for example, similar to light guides or back light units that provide illumination in LCD displays. In this case, the light guide may provide illumination for an LCD type display on one side of the segment and room illumination on the back or non-display side. The light source that couples light into the light guide may be attached on one, two or multiple sides of the segments.

Figure 5:
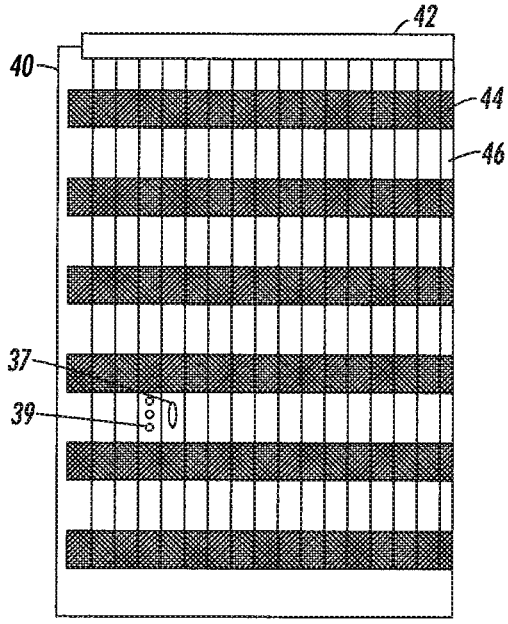
FIG. 5 shows another embodiment of a louver display.

In addition to discrete louver segments, a louver display may consist of a continuous, flexible, transparent substrate. FIG. 5 shows an embodiment of such a substrate 40. In this embodiment, as was mentioned with regard to the discrete louver segments, the gate lines 42 may run continuously down the substrate. The gate lines and the transistors in the active-matrix pixels to drive the display elements may use technologies such as thin film transistor technologies, used for liquid crystal device displays, for examples.

The display will have transparent segments, such as 46, in which no display elements exist, and display segments such as 44 where the display elements reside. The display elements may consist of individual panels that are attached to the substrate in such a manner as to form the necessary electrical connections, or could be envisioned to be manufactured directly on the substrate.

For example, the whole display may be manufactured in a web-based process or roll-to-roll process. The electronics elements may be laminated to the substrate or they may be directly fabricated on the transparent flexible substrate by a known patterning technique. For patterning the conductors or electronic elements, such as pixel circuits, photolithography, etching, laser ablation and thin film deposition techniques may be used. However, also printing methods may be used to pattern the circuitry on the flexible substrate. Printing may include screen printing, gravure printing, offset printing, flexographic printing, ink-jet printing, aerosol printing, stamping, pad printing, laser transfer printing, etc.

In one example, the circuits are printed using silver nanoparticle ink for the conductors and organic semiconductors (such as pentacene or polythiophenes) for the pixel transistors. In another example, the conducting lines such as gate lines or vertical lines consist of a transparent or semitransparent conductor such as indium tin oxide, zinc oxide, carbon nanotubes or PEDOT:PSS. Using a substantially transparent conducting material for the conducting lines that are patterned in the areas 46 improves the transparency of these areas. The areas 46 may also carry perforations such as holes 39 or slits 37 in order to let air or other substances pass. Such perforations may be stamped, etched or laser-etched into the flexible transparent substrate.

The flexible substrate may consist of a material such as Mylar™ or polyethylene naphtlalate (PEN), or any other transparent or semitransparent material. In one example, the thickness of the flexible substrate is between 1 mil and 4 mil. The flexible substrate may not be necessarily transparent. If, as discussed above, perforations are patterned into the areas 46, transparency or partial transparency can be achieved through these perforations without the substrate material being transparent.

Figure 6:
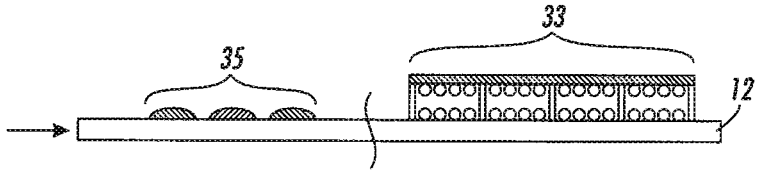
FIG. 6 shows side views of different display types on a louver segment.

In the display regions 44, the display media may be directly patterned onto the substrate or it may be attached. As shown in FIG. 6, for example, in an OLED display such as 35, the OLED material may be printed or evaporated onto the substrate. In an LED based display, the individual LEDs may be attached to the substrate by a pick-and-place method. In an electrophoretic or polymer dispersed liquid crystal display, the display medium may be laminated onto the substrate in the regions 44 or it may be directly printed or coated onto the substrate in the areas 44 shown at 33 in FIG. 6. Of course, also the display elements for the segments shown in FIG. 1 may be fabricated in a roll-to-roll manufacturing method on a flexible substrate. The individual display elements may then be cut out and attached to a support structure to form the segments 14. It should be noted that the substrate 40 may not consist of one and the same continuous substrate, but rather be stitched together. For example, the regions 44 may consist of rigid display panels (e.g. LCD display stripes) and the regions 46 may be bonded to the panels and consist of flexible connectors. In one example, flexible connectors with patterned conducting lines are TAB bonded to the gate signal bus lines of the panels, electrically connecting the neighboring panels.

The above discussion addresses the structure of FIG. 5 as a display structure, but it may be also a solar cell structure, one that is mounted on the back of the louver segments for example. In the case of a solar cell structure, the areas 44 that would form the louver segments are the solar cell regions and may open and/or close in synchronization with the sun or other light source, either on a timer or using a light sensor to track the sun or light source. A motor may provide the movement of the louver segments to allow them to track the light source. In one example they are printed organic solar cells, in another example they are crystalline silicon solar cells attached to a flexible substrate. The region 44 may consist of a continuous layer or it may consist of many individual solar cells, such as pieces of silicon solar cell wafers, which are butted together. The vertical lines 42 that connect the areas 44 are in this case the grid connections which connect the cells in series or in parallel to storage store the collected energy. In a series connection, the lines 42 would not be continuous, but connect the anode of one cell to the cathode of a neighboring cell.

Figure 7:
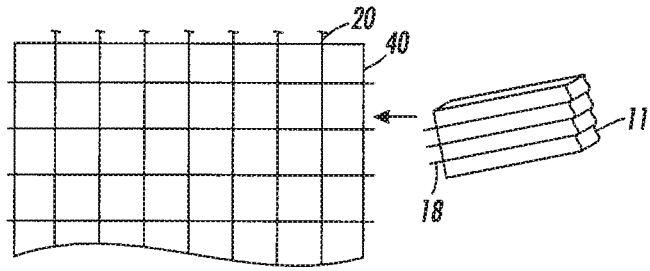
FIG. 7 shows an embodiment of a driver circuit.
Figure 8:
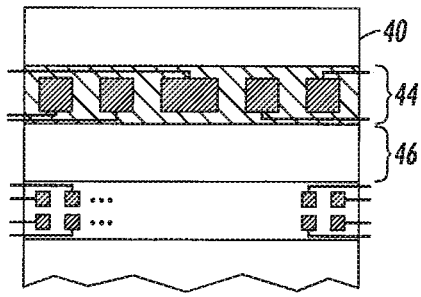
FIG. 8 shows an embodiment of an alternative driver circuit.

As discussed before, the active-matrix driving scheme is just one example. In a passive-matrix addressing scheme, the gate lines 42 of the active-matrix scheme are equivalent to the vertical lines on one side of the display media and the horizontal lines oriented in the same direction as the data lines in an active-matrix addressing scheme are on the other side of the display media shown in FIG. 7. In some passive-matrix addressed displays such as LED displays, the horizontal and vertical lines may be on the same substrate, isolated by a dielectric layer and the LEDs may be connected to both lines. Moreover, if the display elements or pixels are addressed by a direct addressing method, the substrate may also be continuous without vertical lines 42 running between the segments. A direct addressed display is shown in FIG. 8, with the electrodes in the active area of the substrate 44 with clear regions such as 46 in between.

Figure 9:
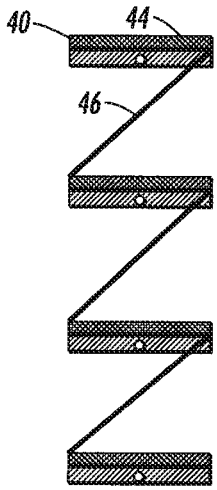
FIG. 9 shows an embodiment of a louver display in an open state.

Using this type of arrangement, when the louver shade is opened, the transparent segments flex and allow the viewer to see through the gaps between the display segments. FIG. 9 shows an example of this configuration. It should be noted that the transparent segments such as 46 will not appear as they do when the substrate is laid flat as in FIG. 5. The mounting of the substrate will be such that there is some slack between the display segments, allowing the transparent segments to fall behind the display segments to allow for an uninterrupted field of view when in the closed position. The areas 44 also may be attached to a more rigid segment for stability. This segment may also carry the mounting and hinge mechanism for the segment to rotate.

Figure 10:
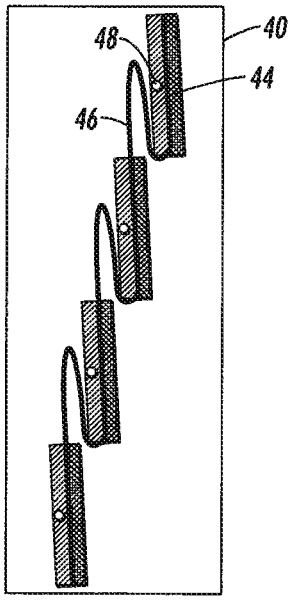
FIG. 10 shows an embodiment of a louver display in a closed, or display, state.

FIG. 10 shows the substrate with the louver in the closed position. As can be seen, the transparent segments such as 46 move behind the display segment 44 when closed. This will generally be determined by the position of the mounting points such as 48 for each display segment relative to the other display segments. The quality of the view in the open position may not be the same as when there is no material there, but the manufacturability and reliability may be higher due to the ability to have uninterrupted and linearly routed gate lines. Moreover, for some applications it may be desirable to have an airtight louver display without open gaps between the louver segments.

Figure 11:
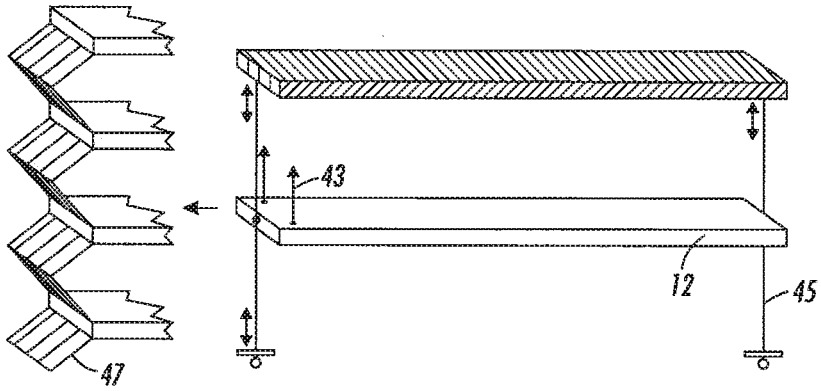
FIG. 11 shows an embodiment of a pull-up louver display.

Other configurations for the louver display are also possible. FIG. 11 shows one example, where the display is arranged like a window blind with the ability to turn the louver segments such as 12 and their associated display panels in a vertical or horizontal position. The vertical position would be when the blind is closed. As is common in many window blinds, pulling a string such as 43 would cause the elements to turn to the horizontal position. Pulling the string 45 would cause the louver segments to pull up into a stack at the top of the frame. Element 47 shows an alternative embodiment such as a folding structure to pull the elements together into a stack. It must be noted that in this instance, the 'frame' actually consists of the strings. The term 'frame' merely indicates a structure around which the louvers are organized and either support or suspend the louver segments.

Figure 12:
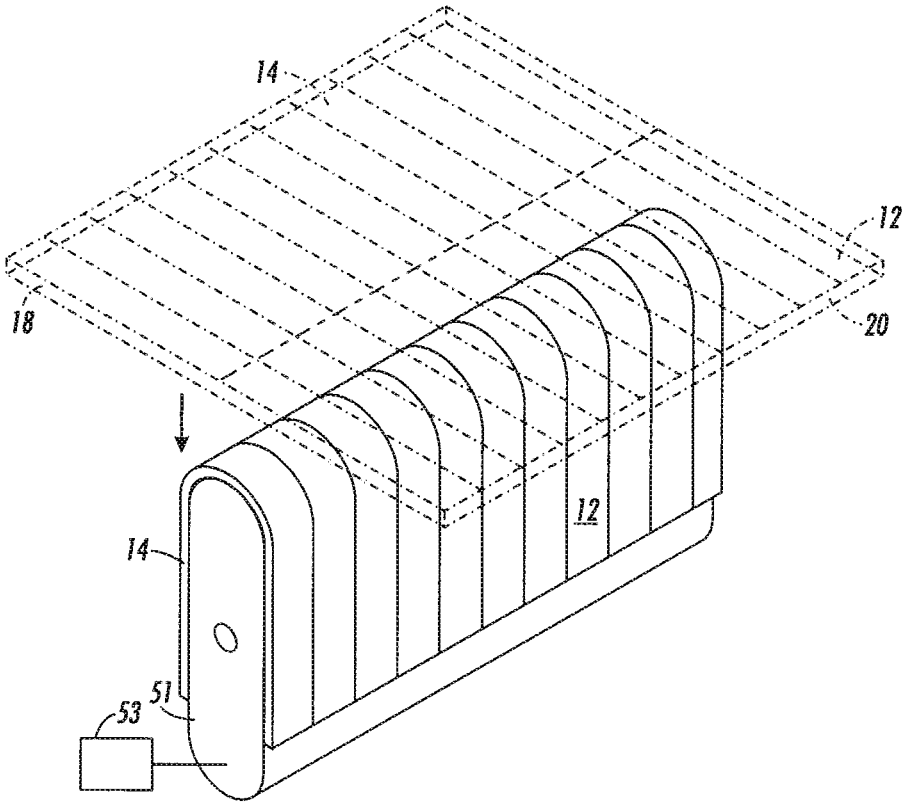
FIG. 12 shows an embodiment of a louver display where the louver segments are folded.
Figure 13:
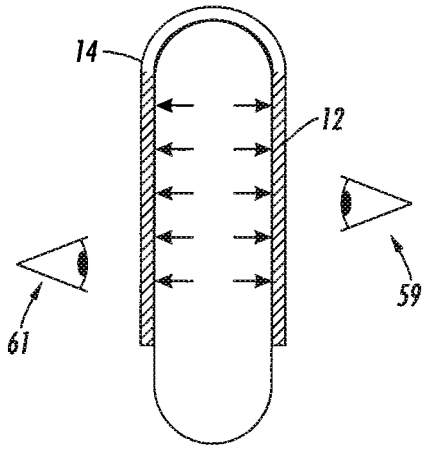
FIG. 13 shows a side view of an embodiment of a folded louver display.

FIGS. 12 and 13 show another possible arrangement. In this instance the louver segments would be formed out of one substrate and then folded. In FIG. 12, the larger substrate would fold along the fold line 49, with segment 12 on one side of the fold line and segment 14 on the other. The display may include a light source 53, which produces light and then transmits it through a light guide 51 to the louver segments 12 and 14. The light guide may be made of a material such as glass or plexiglass with roughened surfaces to couple light out or the plexiglass slab. The light source 53 may consist of LEDs attached to or embedded into the glass or plexiglass slab. Other possible light sources are for example laser light sources or a cold cathode fluorescent (CCF) lamps. FIG. 13 shows the side view, where a first viewer 59 may be viewing a different view than viewer 61.

Figure 14:
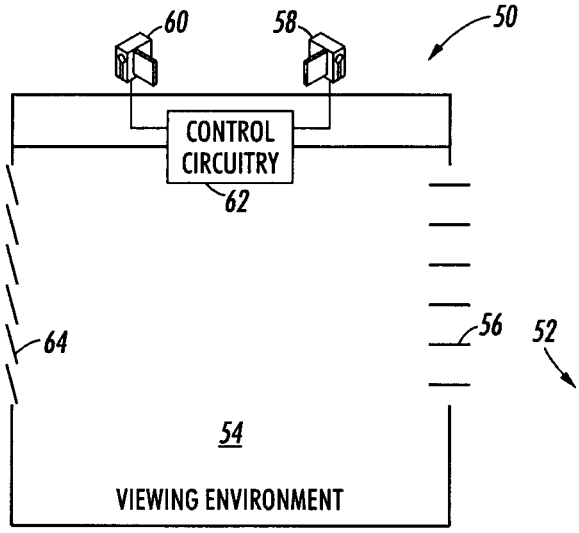
FIG. 14 shows an embodiment of a vehicular mounted louver display system.

The ability to display information on a louver display as discussed in the various embodiments above may provide many alternatives. FIG. 14 shows a system made possible by using louver displays. The system 50 provides a viewer who is sitting or standing inside a structure or vehicle to be able to 'see' outside while remaining protected.

In FIG. 14, the viewer is in the viewing environment 54. When the louvers are opened such as those in louver shade 56, the user can see the environment 52 directly. If the viewer is in a dangerous situation, the viewer could close the louver shade, as shown by 64. The viewer would then view the display on the viewing environment side of the louver 64, the display being fed in real time by one or more cameras such as 58 and 60 mounted on the vehicle or structure.

As a further enhancement, the non-display side of the louver segments may be made impact resistant, bullet proof or radiation resistant. The outside surface of the louvers could be made of, or covered in, Kevlar®, ceramic, armor plating or other bullet proof or impact resistant material or radiation resistant material such as lead shielding against x-ray or other particle radiation or temperature reflective material such as aluminized matting for shielding against heat radiation. The viewer would be safer inside the viewing environment, while still being able to monitor the external environment. For example, a soldier could be riding in a vehicle when the vehicle enters a fire zone. The soldier closes the louvers to provide bullet proof protection to him or her and any others in the vehicle, while 'seeing' the environment on the displays. Moreover, if louver segments are mounted which function on one side as a display, such electrophoretic display, and on the other side as a light source, such as an attached LED strip, the louver display may function as a warning sign which can display a message and emit a flashing signal, such as by rotating the louver segments. This kind of display may be stationary or mounted on a vehicle.

Regardless of the application of the louver shade displays, it is possible to provide louver shades that have displays. The displays may be used for video or changing still images, slogans, signs, etc., in a programmable and flexible fashion, while still providing the user with the ability to open the louvers to let in light and/or air.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A display, comprising:

a louver shade having at least two louver segments;

a display segment mounted on each louver segment, each display segment being a part of a larger display, wherein the louver segments have a display segment mounted on a first side and one of a solar panel or an area light source on a second side, the display segments forming a portion of a continuous, flexible, at least partially transparent substrate, the louver segments mounted to predetermined segments of the flexible substrate, the predetermined segments containing at least part of the drive electronics for the display segment;

drive electronics electrically coupled to each display segment to provide image data to display elements in the display segment; and a control circuit to provide the image data to the drive electronics, the control circuit arranged to provide display data when the louver segments are in a closed position.

2. The display of claim 1, wherein the louver segments have horizontal and vertical sides, the louver segments having a horizontal dimension greater than a vertical dimension, the louver segments being attached to a frame at the one of either the horizontal or vertical sides.

3. The display of claim 1, wherein the louver segments have horizontal and vertical sides, the louver segment having a vertical dimension greater than a horizontal dimension, the louver segments being attached to a frame at the horizontal sides.

4. The display of claim 1, wherein the louver segments are arranged to rotate between a first closed position and a second close position, the second closed position being approximately 180 degrees from the first closed position.

5. The display of claim 1, wherein the louver segments have display segments mounted on a front side and a back side, the display segments comprising one of light emitting diode (LED) display, plasma display, LCD display, nematic LCD display, ferroelectric LCD display, reflective cholesteric LCD display, polymer dispersed LCD display, backlit/transflective LCD display, OLED display, electrophoretic display, powder display, Gyricon display, electrochromic display, electrodeposition display, interference or electrowetting display, or electroluminescent display.

6. The display of claim 1, wherein the louver segments have a display segment mounted on a first side and one of an impact resistant shield or a radiation resistant shield on one of either the first side or a second side.

7. The display of claim 1, wherein the drive electronics comprise active matrix addressing circuitry.

8. The display of claim 1, wherein display element address lines are arranged to run horizontally to a vertical edge.

9. The display of claim 8, wherein the display element address lines are routed to a common point away from the louvers at which the control circuit resides.

10. The display of claim 1, wherein the louver segments are arranged in the frame to allow the segments to be stacked together.

11. A display, comprising:

a louver shade having at least two louver segments;

a display segment mounted on each louver segment, each display segment being a part of a larger display, wherein the louver segments have display segments mounted on a front side and a back side, the display segments comprising one of light emitting diode (LED) display, plasma display, LCD display, nematic LCD display, ferroelectric LCD display, reflective cholesteric LCD display, polymer dispersed LCD display, backlit/transflective LCD display, OLED display, electrophoretic display, powder display, Gyricon display, electrochromic display, electrodeposition display, interference or electrowetting display, or electroluminescent display, and the display segments mounted on the front side and the back side are of different display technologies;

drive electronics electrically coupled to each display segment to provide image data to display elements in the display segment; and a control circuit to provide the image data to the drive electronics, the control circuit arranged to provide display data when the louver segments are in a closed position, wherein the display segments mounted on the front side and the back side are of different display technologies.

12. A display, comprising:

a louver shade having at least two louver segments, wherein the louver segments are each a portion of a substrate, the substrate being folded about a center line, such that the louver segments reside on opposite sides of the center line;

a light source and a light guide positioned to provide illumination to the display segments on the louver segments;

a display segment mounted on each louver segment, each display segment being a part of a larger display, wherein the louver segments have a display segment mounted on a first side and one of a solar panel or an area light source on a second side;

drive electronics electrically coupled to each display segment to provide image data to display elements in the display segment; and a control circuit to provide the image data to the drive electronics, the control circuit arranged to provide display data when the louver segments are in a closed position.

* * * * *